US006161729A

United States Patent [19]

Gentile et al.

[11] Patent Number: 6,161,729

[45] Date of Patent: Dec. 19, 2000

[54] DUAL CHAMBER DISPENSER

[75] Inventors: James Louis Gentile, Orange; Robert Alfread Bennett, Easton, both of Conn.

[73] Assignee: Unilever Home & Personal Care USA, division of Conopco, Greenwich, Conn.

[21] Appl. No.: 09/267,858

[22] Filed: Mar. 12, 1999

Related U.S. Application Data

[60] Provisional application No. 60/112,382, Dec. 14, 1998.

[51] Int. Cl.[7] ..... B65D 35/22

[52] U.S. Cl. ..... 222/94; 222/129; 222/143; 222/494

[58] Field of Search ..... 222/94, 96, 129, 222/143, 490, 494

[56] References Cited

U.S. PATENT DOCUMENTS

| | | | |
|---|---|---|---|
| 2,772,116 | 11/1956 | Dobkin | 222/490 |
| 3,581,940 | 6/1971 | Cella | 222/94 |
| 4,487,757 | 12/1984 | Kiozpeoplou . | |
| 4,687,663 | 8/1987 | Schaeffer . | |
| 4,964,539 | 10/1990 | Mueller . | |
| 5,020,694 | 6/1991 | Pettengill . | |
| 5,038,963 | 8/1991 | Pettengill et al. . | |
| 5,137,178 | 8/1992 | Stokes et al. | 222/94 |
| 5,318,203 | 6/1994 | Iaia et al. . | |
| 5,702,033 | 12/1997 | Beaver . | |
| 5,823,391 | 10/1998 | Klauke et al. . | |
| 5,833,121 | 11/1998 | Gueret . | |
| 5,954,231 | 9/1999 | Durliat et al. | 222/94 |

FOREIGN PATENT DOCUMENTS

| | | |
|---|---|---|
| 2 643 615 | 2/1989 | France . |
| 94/19251 | 9/1994 | WIPO . |
| 98/13274 | 4/1998 | WIPO . |

*Primary Examiner*—Kevin Shaver
*Assistant Examiner*—Thach H Buj
*Attorney, Agent, or Firm*—Milton L. Honig

[57] ABSTRACT

A dual-chambered dispenser is provided including a pair of elongated hollow tubes containing separate flowable material streams, a manifold for directing the flow through separate chambers, a cap fitting over dispensing openings of the manifold and a metering valve located within the manifold downstream from the dispensing openings. The valve is present to adjust differences in flow rates between the two material streams. In a preferred embodiment, the tubes are juxtaposed along their respective flat outer walls which may include a series of ribs/depressions allowing for coupling of the tubes and strengthening the flat walls against collapse relative to other wall areas of the tubes. Advantageously the valve is a duckbill type and the tubes taper in a pear shape, the broader portion being near the open end of the tubes.

2 Claims, 4 Drawing Sheets

DUAL CHAMBER DISPENSER

CROSS-REFERENCE TO RELATED APPLICATIONS

This application is a completion of U.S. Provisional Application Ser. No. 60/112,382 filed Dec. 14, 1998.

BACKGROUND OF THE INVENTION

1. Field of the Invention

The invention concerns a dispenser for simultaneously delivering two compositions from separate chambers of the dispenser.

2. The Related Art

Not all chemical ingredients are mutually compatible. Separation may be required because of chemical reactivity or physical incompatibility during storage. Certain health and beauty aids, cleaning compositions and dental formulas may be benefited by packaging that separates respective components of these products. Of particular concern have been dental products which require simultaneous delivery of mutually reactive sodium bicarbonate and hydrogen peroxide.

The art has described a number of packages that separate reactive components by placing their compositions in different chambers. Only at the point of use are these compositions combined. For instance, U.S. Pat. No. 5,020,694 (Pettengill) and U.S. Pat. No. 5,038,963 (Pettengill et al) describe rigid piston-type multi-cavity dispensing containers for simultaneous co-extrusion of two or more flowable materials in a predetermined proportion. These rigid containers have the advantage of relatively good control over the co-extrusion process. On the other hand, a considerable amount of plastic is involved in their construction. For environmental reasons, packaging with less plastic is sought.

Another suggestion in the art has been to utilize side-by-side collapsible tubes for toothpaste compositions. Representative of this technology is U.S. Pat. No. 4,487,757 (Kiozpeoplou), U.S. Pat. No. 4,687,663 (Schaeffer) and U.S. Pat. No. 4,964,539 (Mueller). Each of these disclosures describes a pair of tubes that have been crimped at an end distant from the product dispensing cap end. Actual attempts to crimp the ends of similar tube designs have resulted in improper seals. Not only were the resultant crimps difficult to form, but leakage was also noted in several instances.

U.S. Pat. No. 5,318,203 (Iaia et al.) reports a dual-chamber dispenser which includes a cap having a dispensing base and a cover, and a pair of elongated hollow tubes. At an upper dispensing end of each of the tubes is an exit orifice and a coupling mechanism for attachment to an underside of the dispensing base. The upper dispensing end is D-shaped in cross-section. The lower end of the hollow tube is either round or oval in the cross-section. After being filled with respective product streams, the lower ends of the pair of hollow tubes are crimped together to form a seal. Although this package is a significant advance over the art, a problem exists in the dispensing of both streams equally and simultaneously from both tubes. The dispensing problem is especially notable as the package reaches exhaustion of product. Separation of the tubes by their outward bowing as product within nears depletion is another functional and aesthetic problem.

U.S. Pat. No. 5,702,033 (Beaver) embellishes upon the Iaia et al. disclosure by tapering the openings of each compartment towards a common nozzle. Yet the basic problems of even extrusion and avoidance of bowing still remain.

Accordingly, it is an object of the present invention to provide a dual chamber thin walled dispenser utilizing less plastic than rigid packages while still providing good control over co-extrusion of the components.

Another object of the present invention is to provide a dual chamber dispenser utilizing a pair of flexible tubes whose ends can readily be crimped and whose crimp provides an adequate seal.

Another object of the present invention is to provide a dual chamber dispenser from which respective separate streams can be extruded in an even manner.

Yet a further object of the present invention is to provide a dual chamber dispenser wherein respective streams from each chamber can be uniformly dispensed even when most of the stream has been extruded from the package.

Other objects, features and advantages of this invention will become more apparent upon the reference of the following detailed description and drawings illustrating preferred embodiments of the invention.

SUMMARY OF THE INVENTION

A dual-chambered dispenser with separate flow paths for a pair of material streams is provided which includes:

- a pair of hollow tubes each defined by intersecting curved and flat outer walls along a longitudinal length thereof, the flat outer walls of the pair being positioned juxtaposed to one another, each of the tubes having a closed and an open end, an exit orifice and a coupling ridge being formed at the open end;
- a manifold for directing separate flow of material from each of the tubes being positioned over the open ends, the manifold including a skirt wall with projections on an inner surface for engaging the coupling ridge and a pair of non-communicating flow chambers terminating in respective dispensing openings;
- a cap fitting over the dispensing opening; and
- a metering valve located between the exit orifice and the dispensing openings in at least one of the separate paths.

In one of the embodiments according to the present invention only a single metering valve is present in the dispenser. A second embodiment positions a metering valve along a flow path for each of the streams.

Duckbill valves are suitable as metering valves according to the present invention. Structures typical of duckbills are those with a closable mouth at one end of a valve body, a longitudinal axis traversing a center point of the body and the valve mouth oriented off-center from the longitudinal axis. A very useful arrangement is where two metering valves are present, each of the valves having a different size closable valve mouth which results in different flow rates for the respective pair of material streams.

When two identical metering valves are present, the valves may have a closable valve mouth and each mouth may be oriented differently from the other. Selective orientation is another way to obtain different flow rates for the respective pair of product streams.

The flat outer walls of the tubes are provided with at least two elongate outwardly projecting ribs. Furthermore, one of the two flat outer walls may have at least one more rib than a second of the flat outer walls. In this situation the ribs of both the first and second flat outer walls are different in number. Thereby, they can interlock with one another allowing flat areas of each of the respective walls to flushly adjoin. Besides an interlocking function, the ribs strengthen the flat outer wall so it can remain rigid relative to the curved outer wall. Consequently, when a tube begins to partially collapse after dispensing product, it will be the curved outer wall rather than the flat outer wall that collapses. Absent this difference in collapse rate, the tubes would bow away from one another hindering simultaneous, even extrusion of material streams from both tubes.

The outwardly projecting ribs are preferably arranged longitudinally oriented in a direction defined by an axis traversing from the exit orifice to the closed end of the tube. Less preferred but useful is an arrangement where the ribs are arranged laterally and orthogonally intersect the axis that traverses the exit orifice and closed end of the tube.

Advantageously the tubes along the curved outer wall taper outwardly from the closed to the open end. The arrangement of the taper resembles a pear shape. Advantages of this shape include enhancement of product evacuation. The material stream is directed toward the orifice rather than flowing backwards toward the closed end. A pear shape is also a more comfortable fit for the hand. In an alternative embodiment, the outer wall of the tube can be formed with parallel (rectangular) outer walls rather than being tapered.

A narrow crimped seal is formed at the closed end. This seal reduces area for material to be trapped in the tube. The narrow end also helps direct a consumer away from the seal. There will be a natural tendency to grip near the wider area adjacent the open end of the tube. Better dispensing occurs because the bulk of material is contained in that wider upper area.

Valves according to the present invention operate to provide even dispensing, achieve near full product evacuation, maintain freshness of product and allow for metered product flow. Most preferably the valves should have an anti-suck back functionality which restricts air from entering the tube after each extrusion stroke.

DETAILED DESCRIPTION OF THE DRAWING

The above features, advantages and objects of the present invention will more fully be understood by consideration of the drawing describing an embodiment thereof in which:

FIG. 7 is a right side elevational view of the chamber shown in FIG. 5, the left side elevational view of FIG. 6 is similar;

Figure 8:
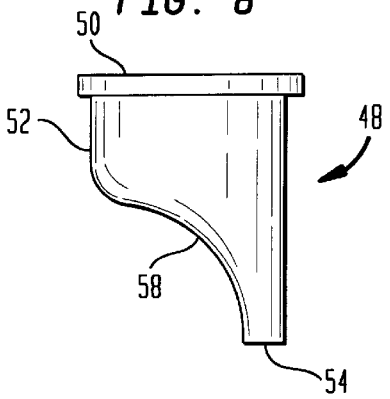
FIG. 8 is a side elevational view of a duckbill metering valve.
Figure 10:
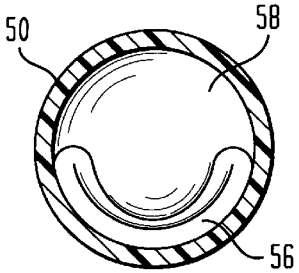
Figure 11:
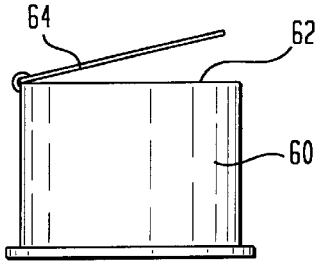
Figure 12:
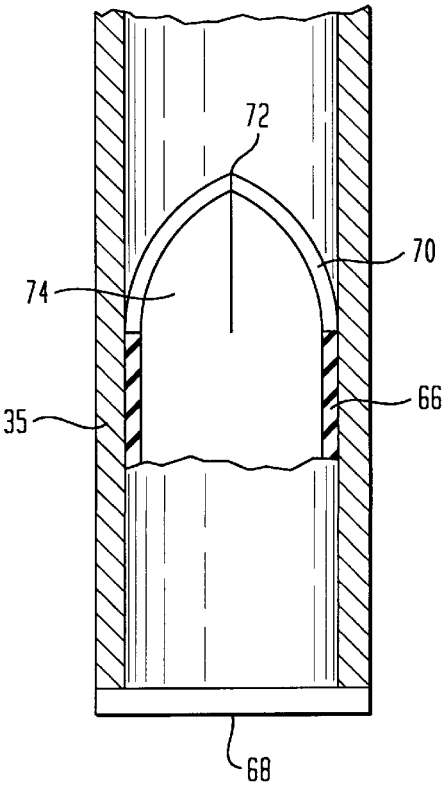
Figure 13:
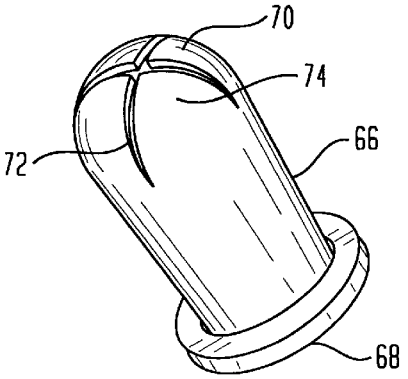
Figure 14:
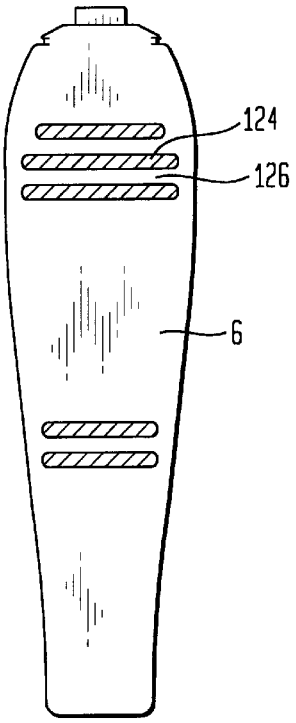
Figure 15:
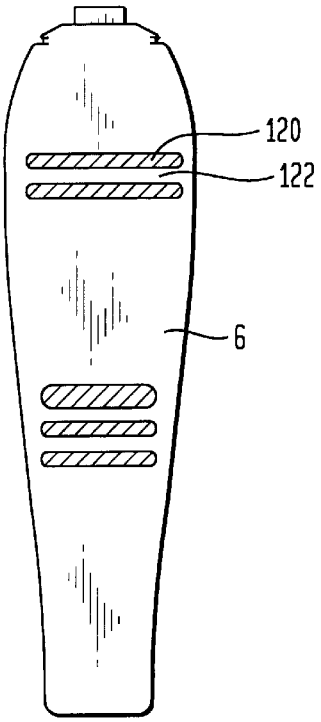
Figure 16:
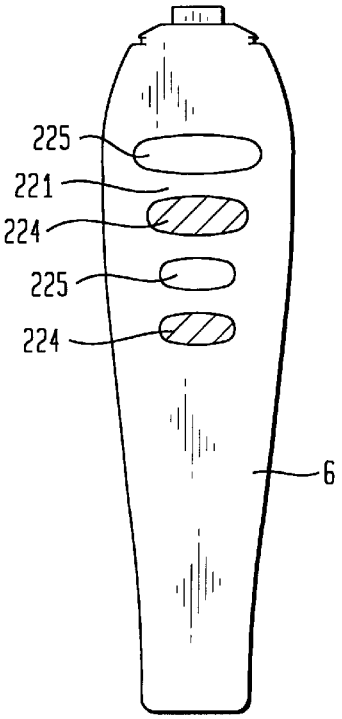

FIG. 10 a top elevational view of the duckbill valve shown in FIG. 8 and illustrating a closed valve position;

FIG. 11 is a side view of a second embodiment of a metering valve according to the present invention;

FIG. 12 is a perspective view of a third embodiment of a metering valve in open position according to the present invention;

FIG. 13 is a cross sectional view of the metering valve according to FIG. 12 held in a closed position;

FIG. 14 is a rear view of a second embodiment of the left tube;

FIG. 15 is a rear view of a second embodiment of the right tube;

FIG. 16 is a rear view of a third embodiment of the left tube; and

Figure 17:
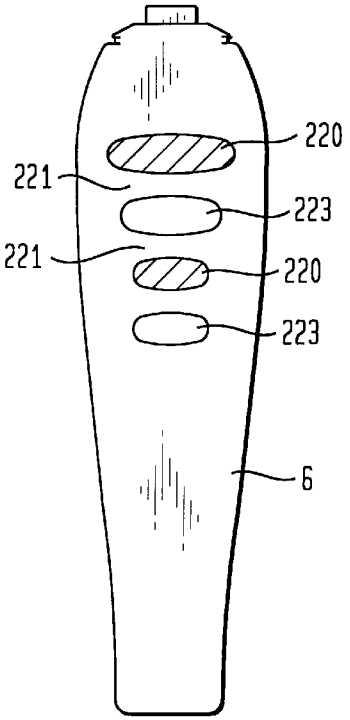

FIG. 17 is a rear view of a third embodiment of the right tube.

DETAILED DESCRIPTION OF THE INVENTION

Figure 1:
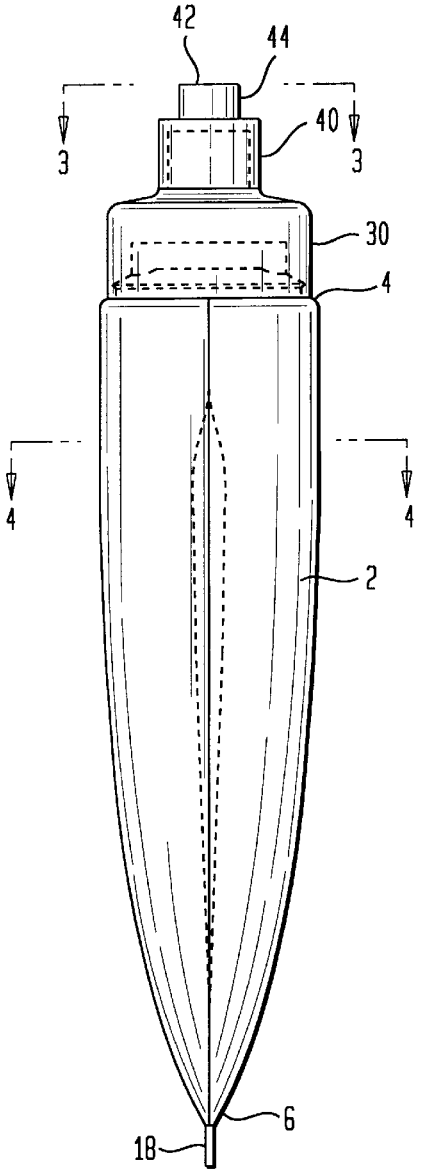
FIG. 1 is a side elevational view of a dual compartment dispenser according to the present invention.
Figure 2:
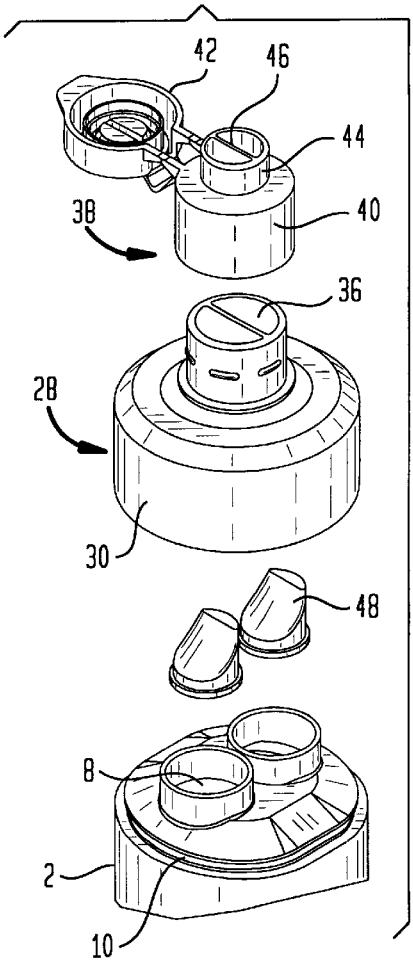
FIG. 2 is an exploded view of the cap, dispensing system and duckbill valves along an upper section of the dispenser of FIG. 1.

A dual chamber dispenser according to the present invention is shown in FIG. 1. Different semi-viscous material streams are respectively placed in a pair of elongated hollow tubes 2. Each of the tubes has an open end 4 and a closed end 6. An exit orifice 8 is formed at the open end of the tube. Adjacent the open end is also found a coupling ridge 10. FIGS. 4–7 illustrate how the hollow tubes are defined along a longitudinal length thereof by an intersecting pair of outer walls 12 which respectively are generally curved 14 and generally flat 16. The generally flat outer walls of the pair are juxtaposed next to one another.

Figure 5:
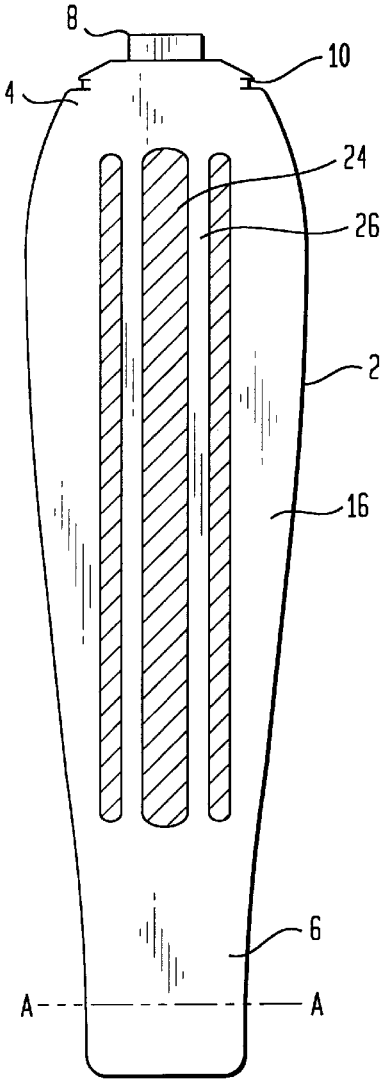
FIG. 5 is a rear view of the left tube of the multi-chamber dispenser according to FIG. 1.
Figure 6:
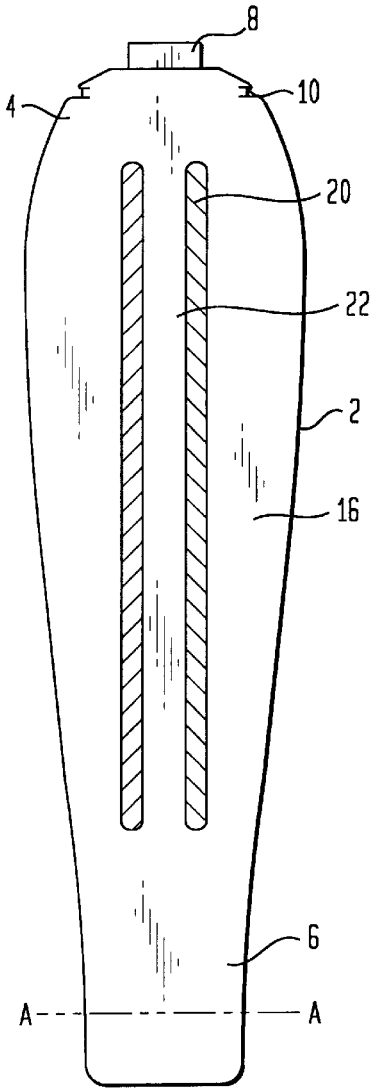
FIG. 6 is a rear view of the right chamber of the multi-chamber dispenser according to FIG. 1.
Figure 7:
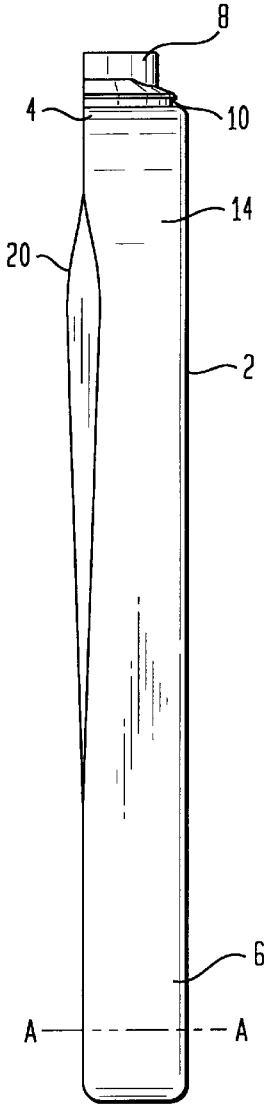

FIGS. 5–7 illustrate the tubes 2 in molded form as they are produced from a molding machine. Prior to assembly, tips near the bottom end of the tubes are cut along a line A—A. Subsequently, left and right tubes are joined together with their flat outer walls juxtaposed. A sealing bar is then pressed against the cut edge to form a crimp seal 18, best shown in FIG. 1.

A set of two elongate outwardly projecting ribs 20 with adjacent depressions 22 are formed in the right tube. Three similar elongate outwardly projecting ribs 24 are formed in the flat outer wall of the left tube and are flanked by respective depressions 26. When the flat outer walls of the tubes are flushly juxtaposed, the ribs of one tube will mate with respective depressions on the other. Interlocking of the ribs/depressions allows the flat areas of each of the outer wall surfaces to flushly adjoin.

FIGS. 14 and 15 illustrate a second embodiment of the projecting ribs 120. The ribs are oriented orthogonal to a longitudinal axis of the tube which traverses the exit orifice and closed end. Each outwardly projecting rib 120 has an adjacent depression 122. Three similar elongate outwardly projecting ribs 124 are formed in the flat outer wall of the left tube and are flanked by respective depressions 126. A second set of complementary ribs and depressions is formed on a lower end of the tube walls.

A third embodiment of an interlocking system is illustrated in FIGS. 16 and 17. A set of two elongate outwardly projecting ribs 220 are separated by a flat area 221 and a concave pocket 223 formed in the right tube. Two similar elongate outwardly projecting ribs 224 are formed in the flat outer wall of the left tube separated by a flat area 221 and a concave pocket 225. When the flat outer walls of the tubes are flushly juxaposed, the ribs 220 mate with the concave pockets 225 and the ribs 224 mate with the concave pockets 223. Interlocking of the ribs/pockets allows the flat areas of each of the outer wall surfaces to flushly adjoin.

Another important feature of the first embodiment is the curved taper of the outer wall which is broader at the open end 4 and narrower at the closed end 6. The taper resembles a pear shape. See FIGS. 5 and 6.

A manifold 28 is positioned over both open ends of the hollow tubes for directing the separate flow of each material. The manifold includes a skirt wall 30 with projections 32 on an inner surface 34 for engaging the coupling ridge 10. A pair of non-communicating flow chambers 34 defined by walls 35 terminate in respective dispensing openings 36.

A cap 38 is formed by a cap skirt 40 surrounding an outlet barrel 44 with separating septum 46. A cover 42 is attached to the cap skirt via a living hinge and can removably seal the outlet barrel. Cap 38 fits over the dispensing orifices of the manifold 28. In an alternative embodiment, cap 38 may be unitarily formed as a single plastic piece with manifold 28.

Figure 3:
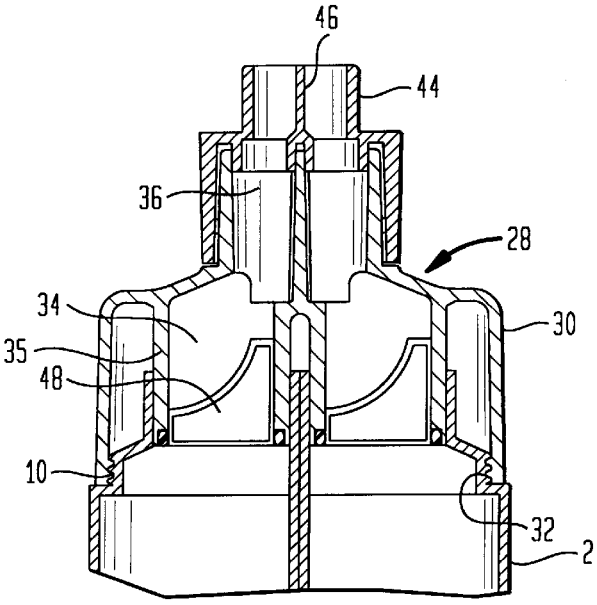
FIG. 3 is a cross-sectional view along line 3—3 of FIG. 1 but showing only the upper end of the dispenser.
Figure 4:
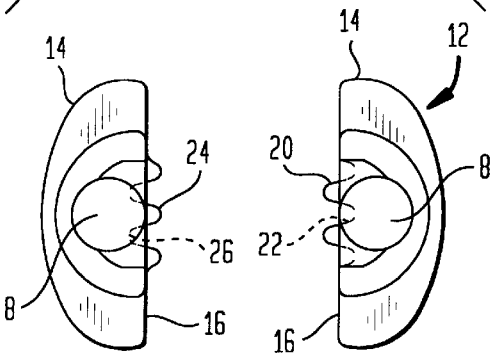
FIG. 4 is a cross-sectional view along line 4—4 of FIG. 1 except that the compartment sections are separated for better viewing.

The embodiment shown in FIG. 3 illustrates a metering valve 48 placed in each of the flow chambers 34. Other embodiments of this invention may only require a metering valve placed in only one of the flow chambers.

Figure 9:
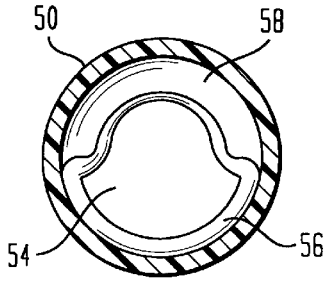
FIG. 9 is a top elevational view of the duckbill valve shown in FIG. 8 and illustrating an open valve position.

FIG. 8 illustrates a duckbill valve with a mouth 50 for receiving material from the open end 4 of the hollow tube. The duckbill further includes a cylindrical body member 52 adjacent the mouth and a valve opening 54 defined by a pair of lips 56 joined by a parabolic wall 58 to the cylindrical body 52. FIG. 9 illustrates valve opening 54 in a dispensing position with lips 56 spread apart. FIG. 10 illustrates valve opening 54 in a closed position with lips 56 tightly shut. The valve opening 54 is oriented off-center from a longitudinal axis traversing a center point of the cylindrical body. The off-centered arrangement allows for placement of the valve opening along different circumferential sectors of the flow chamber 34. Material flow can be further regulated by the nature of that placement. When aligned with the dispensing opening, the valve opening can increase flow rate. Non-alignment hinders the flow. In this manner the flow rates of different viscosity substances in the respective tubes can be manipulated so that these material streams dispense at similar rates from the respective dispensing openings. Another advantage of a duckbill valve arrangement is the anti-suck back feature which allows product to be extruded from the tubes but prevents air from returning into the tube once hand pressure against the walls is released. A much more complete delivery of total product from the tube is achieved by prevention of suck back and evenness of flow is enhanced.

Valves other than those of the duckbill variety may be employed for purposes of this invention. FIG. 11 illustrates a valve with a cylindrical body 60 having a valve opening 62 regulated by a hingedly attached flap 64.

Another embodiment of a valve for use with the present invention is illustrated in FIGS. 12–13. A cylindrical body 66 has a mouth 68 at one end and a sealing cover 70 arranged as a raised dome shape downstream at an exit end. A cross-cut 72 forms a set of four adjoining flaps 74. Pressure from material flow moving downstream from open end 4 of the tubes through mouth 68 presses against flaps 74 forcing them apart and allowing exit out of the valve opening cuts 72. FIG. 13 illustrates in cross-sectional view the closed position with flaps 72 tightly adjoining each other along cuts 72. The dome shape valve has the advantage of functioning equivalently no matter how it is oriented in the flow chambers.

The foregoing description illustrates only selected embodiments of the present invention, variations and modifications all being within the spirit and purview of this invention.

What is claimed is:

1. A dual-chamber dispenser with separate flow paths for a pair of product streams comprising:

a pair of hollow tubes each defined by intersecting curved and flat outer walls along a longitudinal length thereof, the flat outer walls of the pair being positioned juxtaposed to one another and being provided with at least two elongate outwardly projecting ribs with one of the two flat outer walls having at least one more rib than a second of the flat outer walls, each of the tubes having a closed and an open end, an exit orifice and a coupling ridge being formed at the open end;

a manifold for directing separate flow of material from each of the tubes being positioned over the open ends, the manifold including a skirt wall with projections on an inner surface for engaging the coupling ridge and a pair of non-communicating flow chambers terminating in respective dispensing openings;

a cap fitting over the dispensing opening; and a metering valve located between the exit orifice and the dispensing opening in at least one of the separate paths.

2. The dispenser according to claim 1 wherein the ribs of the first and second flat outer walls are different in number and can interlock with one another thereby allowing flat areas of each of the outer walls to flushly adjoin.

* * * * *